US007217087B2

(12) United States Patent
Yoshida et al.

(10) Patent No.: US 7,217,087 B2
(45) Date of Patent: May 15, 2007

(54) CENTRIFUGAL FAN

(75) Inventors: Yusuke Yoshida, Kyoto (JP); Toru Tamagawa, Machida (JP); Tomotsugu Sugiyama, Kyoto (JP); Kazumi Takeshita, Kyoto (JP); Masayuki Aoki, Kyoto (JP)

(73) Assignee: Nidec Corporation, Kyoto (JP)

( * ) Notice: Subject to any disclaimer, the term of this patent is extended or adjusted under 35 U.S.C. 154(b) by 87 days.

(21) Appl. No.: 10/907,275

(22) Filed: Mar. 28, 2005

(65) Prior Publication Data

US 2005/0207887 A1 Sep. 22, 2005

(30) Foreign Application Priority Data

Mar. 26, 2004 (JP) ..... 2004-090986

(51) Int. Cl.
*B63H 1/16* (2006.01)

(52) U.S. Cl. ..... 415/98; 415/203; 415/206

(58) Field of Classification Search ..... 415/98, 415/203, 204, 205, 206
See application file for complete search history.

(56) References Cited

U.S. PATENT DOCUMENTS 801,304 A * 10/1905 Davidson ..... 415/204
1,319,364 A * 10/1919 Skillins et al. ..... 415/206
1,838,169 A * 12/1931 Anderson ..... 415/53.1
4,419,049 A * 12/1983 Gerboth et al. ..... 415/206
4,629,394 A * 12/1986 Leachman, Jr. ..... 415/38
6,273,679 B1 * 8/2001 Na ..... 415/204
6,439,839 B1 * 8/2002 Song et al. ..... 415/204

FOREIGN PATENT DOCUMENTS

JP 3378632 B2 12/2002
JP 2003-035298 A 2/2003
JP 2003-307196 A 10/2003
JP 2005-002918 A 1/2005

* cited by examiner

*Primary Examiner*—Igor Kershteyn
(74) *Attorney, Agent, or Firm*—Judge & Murakami IP

(57) ABSTRACT

A centrifugal fan comprises an impeller, a motor which is connected and rotates the impeller and a housing which has an intake and an air blowing port for housing the impeller. The impeller has a plurality of blades arranged on a circumference. The intake opens opposed to the right end (in FIG. 1) of the impeller. The air blowing port opens opposed to a side of the impeller. A gap enlarged portion, in which the distance between the outer circumference of the impeller and the inner face of the housing starts to increase at a point where the distance between the outer circumferential of the impeller and the surface of a nose portion is smallest therein, the nose portion being a region of the vicinity of an edge portion of the air blowing port, the edge portion being the closest side to the outer circumference of the impeller.

10 Claims, 11 Drawing Sheets

CENTRIFUGAL FAN

BACKGROUND OF THE INVENTION

1. Field of the Invention

The present invention relates to a centrifugal fan, and particularly, the present invention relates to a centrifugal fan that is used for cooling electric products and electronic devices.

2. Background Art

In recent years, the electronic devices are made compact and are provided with high performance. In accordance with this, a cooling fan that is mounted in the electronic device is required to be downsized. In response to downsizing of the electronic device, parts are made highly integrated. Thus a density in a chassis of the device becomes high. Therefore, the cooling fan that is mounted in the electronic device is required to have a high static pressure and large air volume.

Conventionally, a structure of arranging a compact cross flow fan on a heat sink for heat release has been known. However, the compact cross flow fan cannot acquire a high static pressure.

In addition, conventionally, a centrifugal fan that is made thin in an axial direction by making a radius of an impeller shorter than a length of the centrifugal fan in an axial direction has been known. However, in order to acquire required air volume and static pressure, a sectional area orthogonal to an axis is made larger, so that further downsizing is required.

Further, in the fan that is mounted in the electronic device, a noise should be decreased.

A first object of the present invention is to provide a downsized centrifugal fan having a high static pressure and an increased air volume, a second object of the present invention is to provide a downsized centrifugal fan, and a third object of the present invention is to provide a centrifugal fan having noise decreased.

SUMMARY OF THE INVENTION

A centrifugal fan according to the present invention may comprise a plurality of blades arranged on a circumference of a radius r, in which a length h in an axial direction satisfies $2 \leqq h/r \leqq 20$ and r is not more than 25 mm; a connection portion for fixing an end of the blade at other side in the axial direction; an impeller including the blade and the connection portion and having an approximately cylindrical outline; a motor that is connected to the impeller in the connection portion and rotates the impeller along one circumferential direction around a center axis; a housing for housing the impeller; an intake that is formed in the housing and opens opposed to one end in the axial direction of the impeller; an air blowing port that is formed in the housing and opens opposed to a side of the impeller; and a gap enlarged portion, in which the distance between the outer circumference of the impeller and the inner face of the housing starts to increase at a point where the distance between the outer circumferential of the impeller and the surface of a nose portion is smallest therein, the nose portion being a region of the vicinity of an edge portion of the air blowing port, the edge portion being the closest side to the outer circumference of the impeller. The gap of the gap enlarged portion is expanding gradually along the other circumferential direction.

Further, in addition to the present invention, it is more preferable that the gap enlarged portion is provided in the range of 10 degrees to 115 degrees from the edge around the center axis.

According to the above-described invention, it is possible to improve, particularly, both of a static pressure and an air volume. Further, noise can be decreased.

Further, in addition to the present invention, it is more preferable that a width of an opening of the air blowing port is gradually increased toward the outside in a radial direction (the outside surface of the housing from the side of the impeller) on a cross section that is vertical to the center axis of the housing. Further, it is more preferable that at least one side forming the air blowing port has smooth convex shape toward other side on a cross section that is vertical to the center axis of the housing.

Further, in addition to the present invention, it is more preferable that an edge at the other side in an axial direction of the air blowing port is located at the other side in the axial direction relative to the other end of the blade in the axial direction.

According to these inventions, it is possible to increase an air blowing volume.

Further, in addition to the present invention, it is more preferable that the centrifugal fan further may comprise a reinforcing ring for fixing the blades at one end in the axial direction of the blade. The reinforcing ring has a shape that a region opposed to the reinforcing ring in the nose portion is deleted.

Further, in addition to the present invention, it is more preferable that the centrifugal fan may further comprise a reinforcing ring for fixing the blades at one end in the axial direction and at least a portion of the reinforcing ring is exposed from the housing to the outside.

According to these inventions, it is possible to more downsize the centrifugal fan of the present invention.

In addition, a centrifugal fan according to the claim 8 may comprise a plurality of blades extended in an axial direction; a connection portion for fixing an end of the blade at other side in the axial direction; an impeller including the blade and the connection portion and having an approximately cylindrical outline; a motor that is connected to the impeller in the connection portion and rotates the impeller along one circumferential direction around a center axis; a housing for housing the impeller; an intake that is formed in the housing and opens opposed to one end in the axial direction of the impeller; an air blowing port that is formed in the housing and opens opposed to a side of the impeller. An edge portion being the closest side to the outer circumference of the impeller. A nose portion is a region of the vicinity of the edge portion of the air blowing port. A gap between the outer circumference of the impeller and the surface of the nose portion is expanding along the other circumferential direction at the side portion of the air blowing port, the side portion being the nearest to the intake.

According to these inventions, it is possible to make a static pressure at an end of one side in an axial direction of the air blowing port higher.

Further, in addition to the present invention, it is more preferable that, letting an axial length of the blade is h and a radius at outer end in a radius direction of the plural blades is r, r is not more than 25 mm and the length h satisfies $h/20 \leqq r \leqq h/2$.

Thus, it is possible to increase the static pressure more and to increase the air volume more.

Further, in addition to the present invention, it is more preferable that the nose portion is expanded toward the other circumferential direction at the side portion of the air blowing port, the side portion being the nearest to the intake.

Thus, particularly, it is possible to make a static pressure at an end of one side in an axial direction of the air blowing port higher.

If a rated rotation number of the motor is 10,000 per minute, each advantage of the present invention is particularly remarkable.

DETAILED DESCRIPTION OF THE INVENTION

The embodiments according to the present invention will be described with reference to the drawings. In the meantime, in the description of the embodiments, when descriptions indicating upper, lower, light, left, front, and back or the like are used, they indicate the directions on the drawings if not otherwise specified and they do not limit the direction when carrying out the invention.

Figure 1:
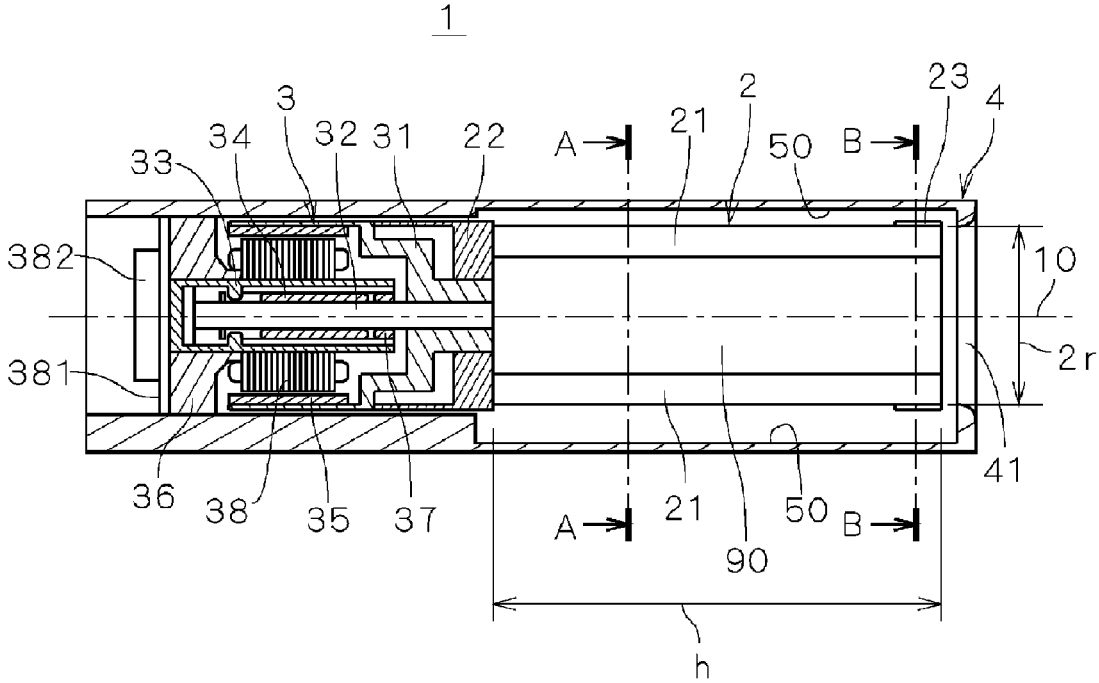
FIG. 1 is a longitudinal sectional view showing an embodiment of a centrifugal fan according to the present invention.
Figure 2:
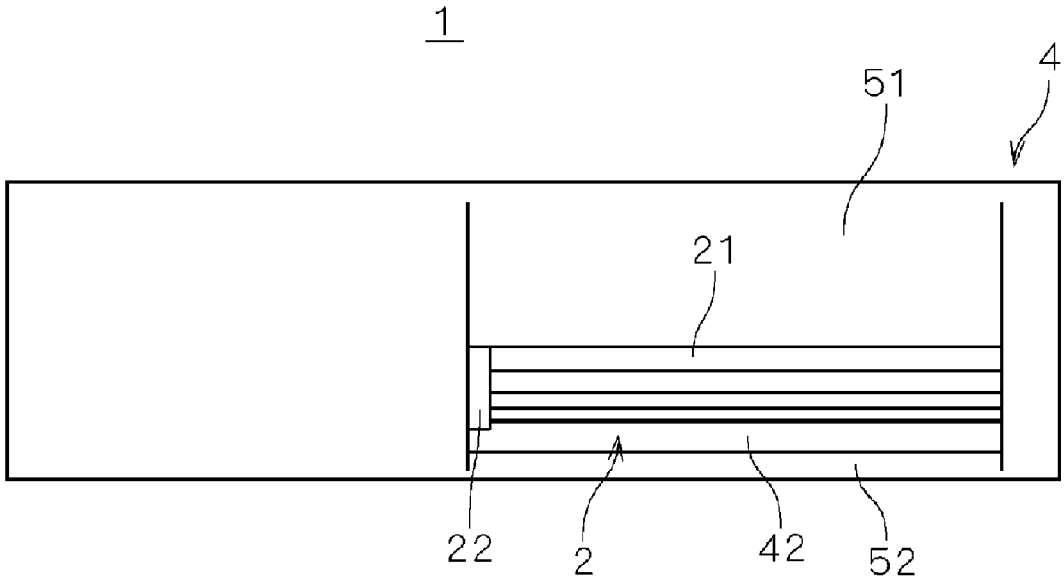
FIG. 2 is a front view showing the centrifugal fan.
Figure 3:
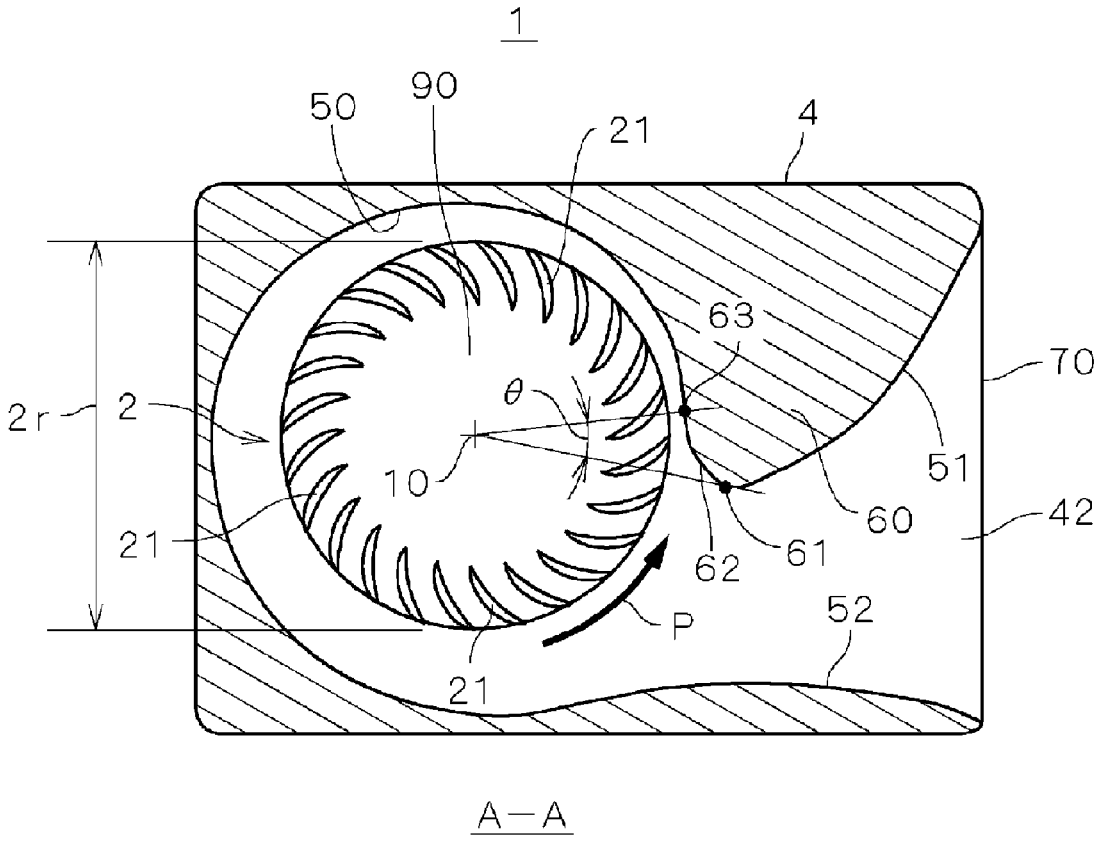
FIG. 3 is a cross sectional view showing the centrifugal fan.

FIGS. 1 to 3 illustrate the structures of a centrifugal fan 1 of the present invention. FIG. 1 is a longitudinal sectional view that is cut at a plain surface including a center axis 10 of the centrifugal fan 1. FIG. 2 is a front view of the centrifugal fan 1. FIG. 3 is a cross sectional view of the centrifugal fan 1 at a line A—A in FIG. 1.

The centrifugal fan 1 is an electric fan. For example, the centrifugal fan 1 is used for cooling electric components, for example, within electric goods and electronic devices, particularly, within portable electronic devices. The centrifugal fan 1 is provided with an impeller 2, a motor 3, and a housing 4. The impeller 2 may generate flow of air while rotating, the motor 3 may rotate the impeller 2, and the housing 4 may accommodate the impeller 2 and the motor 3.

An outline of the impeller 2 is approximately cylindrical in shape. The impeller 2 is configured by a plurality of blades 21, a connection portion 22 for connecting the impeller to the motor 3, and a reinforcing ring 23. The blades 21 may generate flow of air, the connection portion 22 may couple and fix an end of the plural blades 21 at the side of the motor 3 (on the left side in FIG. 1), and the reinforcing ring 23 may fix an end of the opposed side of the connection portion 22 (the right side in FIG. 1). In addition, the reinforcing ring 23 may reinforce coupling of the blades 21. The plural blades 21, the connection portion 22, and the reinforcing ring 23 are integrally formed by resin.

The plural blades 21, as shown in FIG. 3, are arranged at predetermined pitches from a predetermined distance from the center axis 10 with a gap around the center axis 10. In addition, as shown in FIG. 1, the blades 21 are extended in parallel with the center axis 10, respectively. In an inner space 90 encircled by the plural blades 21, air flows from the side of the reinforcing ring 23 upon rotation of the motor 3. In other words, the reinforcing ring 23 is an opening end for guiding air to the space 90 in the impeller 2. The side of the connection portion 22 of the space 90 is closed by connecting the connection portion 22 to the motor 3.

The motor 3 has a rotor yoke 31. The rotor yoke 31 may rotate around the center axis 10 against an approximately platy base 36. The base 36 is fixed to the housing 4. The rotor yoke 31 is connected to the connection portion 22 of the impeller 2. To the rotor yoke 31, a shaft 32 along the center axis 10 is fixed. The shaft 32 is rotatably inserted in a sleeve 34. On an inner circumferential surface of the rotor yoke 31, a rotor magnet 35 is fixed.

A holder 33 in which the sleeve 34 is inserted is fixed to the base 36. A space between an opening of the holder 33 at the side of the impeller 2 and a shaft 32 is closed by a seal 37. In the base 36, a stator 38 for generating a rotational force is fixed around the holder 33. The stator 38 is connected to an electronic part 382 having a driving circuit for supplying a power via a circuit substrate 381 that is attached to a back side (the left side in FIG. 1) surface of the base 36.

By controlling electric current to be supplied to the stator 38, a magnetic interaction is caused between the rotor magnet 35 and the stator 38. Thereby, the impeller 2 that is connected to the rotor yoke 31 of the motor 3 is rotatably driven around the shaft 32. The rotor yoke 31 (and the impeller 2) may rotate in a direction shown by an arrow P in FIG. 3 with the rotation number not less than 10,000 per minute.

As shown in FIG. 1, the housing 4 is provided with the reinforcing ring 23 (the opening end) of the impeller 2 and an intake 41 that is formed opposed to the axial direction. Further, as shown in FIG. 2, the housing 4 is provided with an air blowing port 42 that is formed longer in parallel with the center axis 10 opposed to a side of the impeller 2. The intake 41 is formed in a circle that is approximately the same size as an outer diameter of the impeller 2. As shown in FIG. 3, the air blowing port 42 is expanded outward of the housing 4 and is connected to an inner face 50 encircling the impeller 2.

When the impeller 2 is rotated, air flows from the intake 41 in a space 90 to flow from a space between the plural blades 21, to move along the inner face 50 of the housing 4, and to be discharged from the air blowing port 42.

In this case, an outer diameter **2*r* of the impeller 2 shown in FIG. 1 (r is a radius) is defined to be not more than 25 mm, and a length h in a direction of the center axis 10 of the plural blades 21 is defined as a length satisfying $2 \leqq h/r \leqq 20$. Further, it is more preferable that the length h satisfies $3 \leqq h/r$. In view of a thickness of a notebook type personal computer in recent years, it is more preferable that the outer diameter 2*r* of the impeller 2 is defined to be not more than 20 mm. According to the present embodiment, it is defined that the outer diameter 2*r* is 12 mm and a length h is 27 mm (in this length, a thickness of the reinforcing ring 23** is 4 mm).

In the impeller 2, by satisfying $2 \leqq h/r$, the highest point of a flowing rate of air flowing from the plural blades 21 is in the vicinity of an intermediate between the opposite ends of the blade 21, and as a result, increasing air volume, it is possible to generate air flow with high efficiency. In addition, by satisfying $h/r \leqq 20$, a high speed rotation of not less than 10,000 rotation per minute (for example, 20,000 rotation) is realized without vibration of the impeller 2 and the housing 4. Due to this high speed rotation, air volume is more increased and it is possible to generate air flow having a high static pressure and a high efficiency. In addition, providing the reinforcing ring 23 to the impeller 2, modification of the blade 21 due to a high speed rotation is prohibited.

As shown in FIG. 2, the air blowing port 42 is formed longer in parallel with the center axis 10 (see FIG. 1). Further, the air blowing port 42 is extended from a region opposed to the reinforcing ring 23 to a region over a boundary between the connection portion 22 and the blade 21, namely, a region over an end of the plural blades 21 at the side of the connection portion 22. The static pressure is slightly lowered by making the air blowing port 42 longer at the side of the connection portion 22, however, it is possible to increase the amount of blowing air to be suitable for cooling of the electronic device by just that much.

As shown in FIG. 3, the inner face 50 of the housing 4 is continued to an upper wall face 51 as an upper side of the air blowing port 42 and a lower wall face 52 as a lower side of the air blowing port 42 at a section that is vertical to the center axis 10. In addition, a region in the vicinity of an edge 61 that is adjacent to the impeller 2 of the air blowing port 42 (the vicinity a place where the upper wall face 51 is connected to the inner face 50) is a nose portion 60 projecting to a lower side. In the meantime, the edge 61 is a region at a front end of the nose portion 60, namely, a region most projecting to the opposite direction of the rotational direction of the impeller 2. The air blowing port 42 is formed to be expanded about 20 degrees from a contact point centering on one tangent line of the impeller 20.

A space between the upper wall face 51 and the lower wall face 52 is gradually increased from a region over the edge 61 of the nose portion 60 toward an outer face 70 of the housing 4. In other words, a width of an opening at a section that is vertical to the center axis 10 of the air blowing port 42 is gradually increased from the side of the impeller 2 toward the outer face 70. By gradually making the width of the air blowing port 42 wider, it is possible to make affection due to a viscosity resistance of air at the upper wall face 51 and the lower wall face 52 of the air blowing port 42 small, so that the amount of blowing air can be increased.

In addition, the upper wall face 51 is smoothly convex toward the lower wall face 52 at a section that is vertical to the center axis 10 and the lower wall face 52 is also smoothly convex toward the upper wall face 51 at the section that is vertical to the center axis 10. By making the upper wall face 51 smoothly convex toward the lower wall face 52, whirlpool due to the nose portion 60 can be prevented, affection due to the viscosity resistance of air can be more decreased, and air blowing amount can be more increased. By making the lower wall face 52 smoothly convex toward the upper wall face 51, also at the side of the lower wall face 52, affection due to the viscosity resistance of air can be more decreased, and air blowing amount can be more increased.

The above-described expanded shape of the air blowing port 42 makes the housing 4 larger in a lateral direction in FIG. 3, however, a size in a height direction is not changed, so that it is possible to prevent thickness of the chassis on which the centrifugal fan 1 can be mounted from being larger.

A distance between the inner face 50 and the outer circumference of the impeller 2 is gradually increased from an adjacent point 63 (on the nose portion 60) that is the most adjacent to the impeller 2 along a rotational direction of the impeller 2. In addition, a distance between the inner face 50 and the outer circumference of the impeller 2 is gradually increased toward the edge 61 (namely, toward the opposite direction of the rotational direction of the impeller 2) from the adjacent point 63 on the nose portion 60 to the edge 61 to form a gap enlarged portion 62. In other words, the inner face 50 takes a shape such that a distance between itself and the outer circumference of the impeller 2 is gradually increased from the adjacent point 63 toward the opposite sides.

In this case, a result of noise measurement in the case that the rotation number of the impeller 2 is made into 22,000 rotations per minute while changing a size of a range in which the gap enlarged portion 62 is provided with an angle θ from the edge 61 to the adjacent point 63 centering on the center axis 10 changed is described below. The measurement is carried out with respect to each of the centrifugal fan 1 of FIG. 3 with the angle θ of 15 degrees, the centrifugal fan 1 of FIG. 4 with the angle θ of 100 degrees, and a centrifugal fan 9 of FIG. 5 without the gap enlarged portion (the angle θ is less than 10 degrees and the adjacent point 63 is very close to the edge 61). In any of the centrifugal fans, the outer diameter 2*r* of the impeller 2 is 12 mm and the length h in a direction of the center axis 10 of the plural blades 21 is 27 mm (in this length, a thickness of the reinforcing ring 23 is 4 mm).

As a result of measurement, noise values of the centrifugal fans that the angle θ are 15 degrees, 100 degrees, and less than 10 degrees are 37 dB, 36 dB, and 41 dB, respectively. In other words, a result such that the noise of the centrifugal fan 1 provided with the gap enlarged portion 62 shown in FIG. 3 and FIG. 4 is smaller than that of the centrifugal fan 9 without the gap enlarged portion 62 shown in FIG. 5 by 4 dB and more is acquired.

From these measurement results, it seems that the noise is decreased by providing the gap enlarged portion 62, namely, by providing the adjacent point 63 at a place back of the nose portion 60. The measurement results directly guide that an effect of noise reduction can be acquired when the angle θ is set in the range of 15 degrees to 100 degrees, however, if the angle θ is set in the range of 10 degrees to 115 degrees in view of comparison with the case of FIG. 5 and achievement of high air blowing efficiency, it is expected to acquire an effect of noise reduction. Particularly, in the centrifugal fan 1 under a condition that the outer diameter 2*r* is a small diameter not more than 25 mm and the small impeller 2 that is longer in a direction of the center axis 10 satisfying $2 \leqq h/r \leqq 20$ is used (further, this impeller 2 is rotated at a high speed at 10,000 rotations and over per minute), affection of the viscosity of air is stronger than that due to inertia of air. Therefore, by decreasing the noise, without deteriorating an air blowing property, the air blowing amount can be increased while increasing the static pressure. In the meantime, from the measurement result of FIG. 3, it is preferable that the angle θ is set in the range of 10 degrees to 20 degrees.

Figure 4:
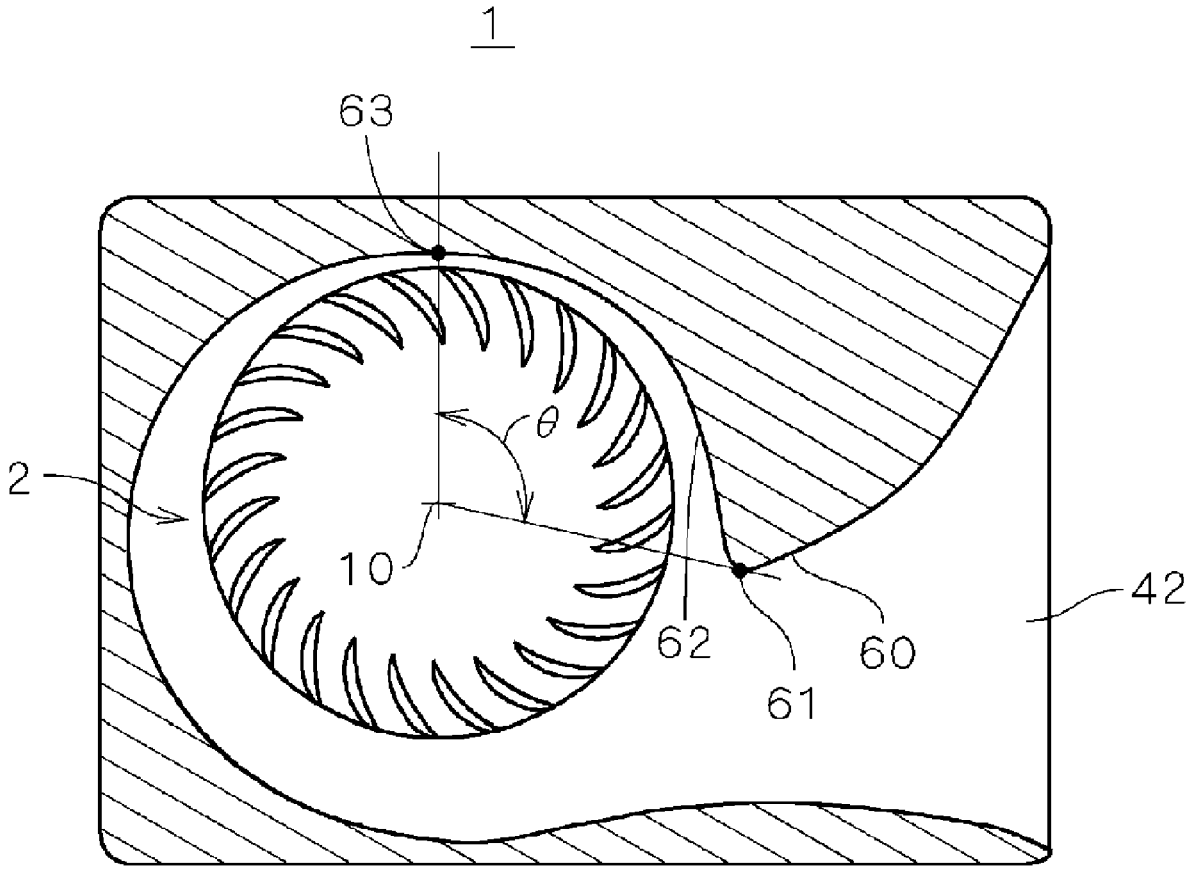
FIG. 4 is a cross sectional view showing other example of the centrifugal fan, to which a gap enlarged portion is provided.
Figure 5:
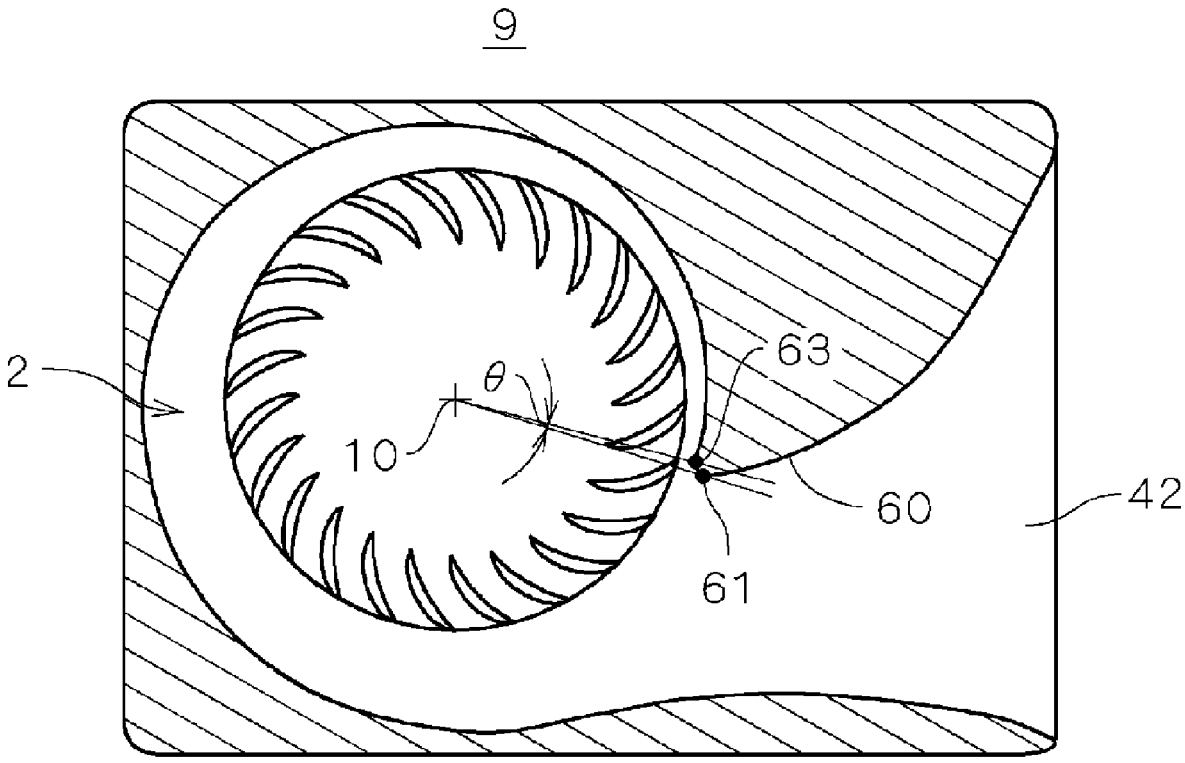
FIG. 5 is a cross sectional view showing other example of the centrifugal fan, to which a gap enlarged portion is not provided.
Figure 6:
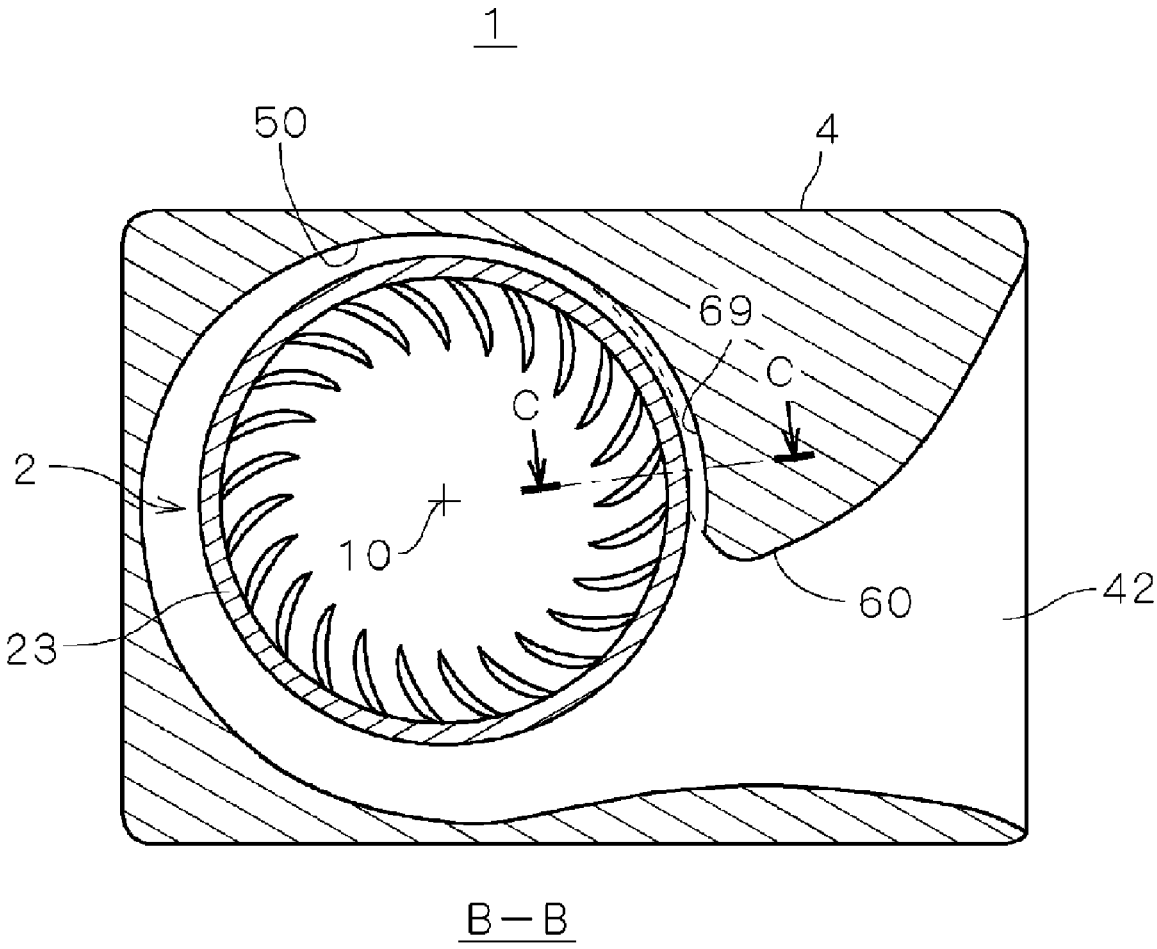
FIG. 6 is a cross sectional view showing the centrifugal fan.
Figure 7:
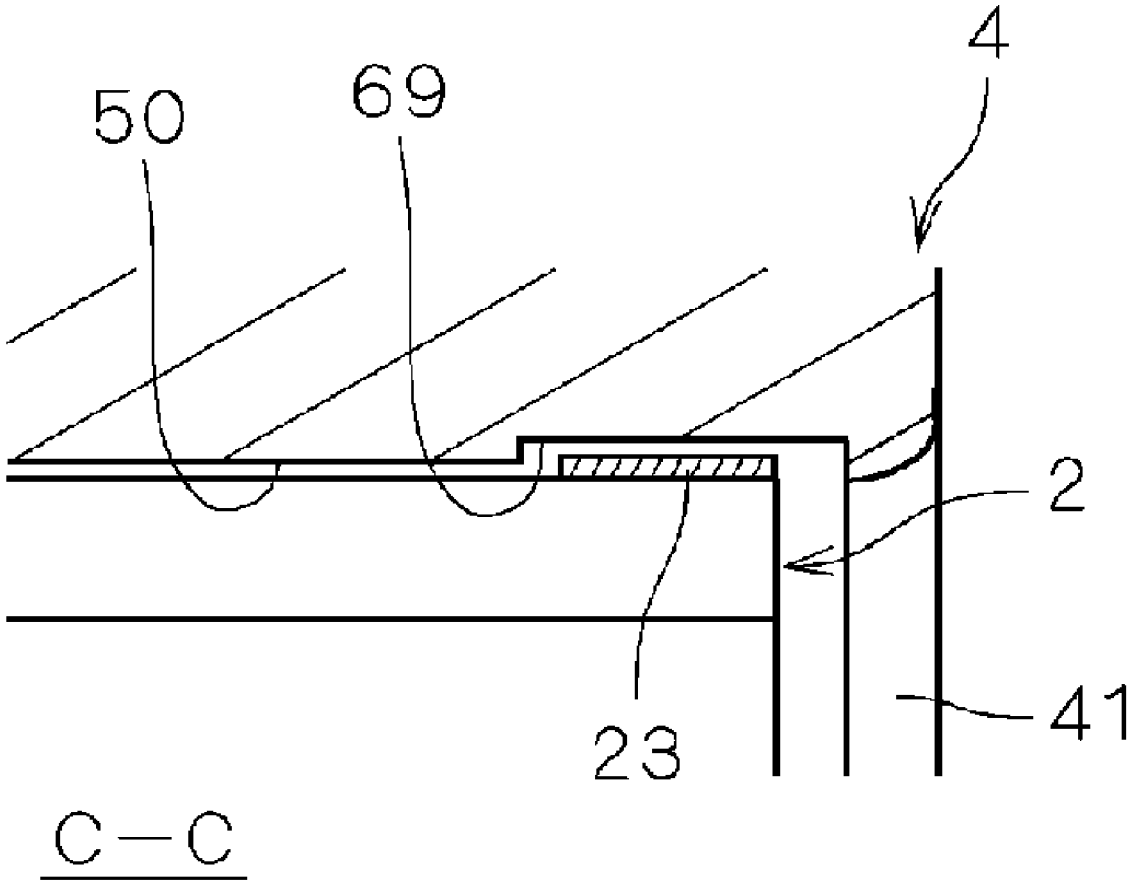
FIG. 7 is an enlarged sectional view of the centrifugal fan.

FIG. 6 is a cross sectional view of cutting the centrifugal fan 1 by a line B—B in FIG. 1, and FIG. 7 is an enlarged sectional view cutting centrifugal fan 1 by a line C—C in FIG. 4.

As shown in FIG. 6 and FIG. 7, the outer diameter of the reinforcing ring 23 is slightly larger than the outer diameters of the plural blades 21, and the region (the region in the vicinity of the adjacent point 63 in FIG. 3) opposed to the reinforcing ring 23 in the nose portion 60 (a portion of the inner face 50) is deleted in accordance with thickness of the reinforcing ring 23 to form a stepped concave portion 69 (in FIG. 6, the deleted region is illustrated by a broken line). Thereby, without contacting the nose portion 60 to the reinforcing ring 23, the shortest distance between the nose portion 60 and the outer circumference of the reinforcing ring 23 can be made sufficiently short. Accordingly, the housing 4 can be downsized (on the section that is vertical to the center axis 10) while realizing the high static pressure. In the meantime, the region opposed to the reinforcing ring 23 in the inner face 50 does not affect the air blowing capability, so that, for example, this region may be a cylindrical face that is coaxial with the center axis 10.

The structure of the centrifugal fan 1 is as described above. In the small and vertically long centrifugal fan 1 that the outer diameter 2*r* of the impeller 2 is not more than 25 mm and the length h of the direction of the center axis 10 of the plural blades 21 satisfies $2 \leqq h/r \leqq 20$, by providing the gap enlarged portion 62 of which gap is gradually increased toward the edge 61 of the nose portion 60, the static pressure is increased, the air blowing amount is increased, and further, the noise is reduced. In addition, the width of the opening of the air blowing port 42 is gradually increased toward the outside face of the housing 4 and this makes it possible to increase the air blowing amount and the noise is reduced. In addition, the air blowing port 42 is elongated over the end of the blade 21 at the side of the connection portion 22 and this leads to more increase the amount of blowing air.

Further, by deleting a portion of the inside of the housing 4 so as to evade interference to the reinforcing ring 23, without lowering the air blowing capability, the centrifugal fan 1 can be more downsized. Thus, due to modification of the shape of the housing 4, a capability of the centrifugal fan 1 is increased and the centrifugal fan 1 is downsized.

Figure 8:
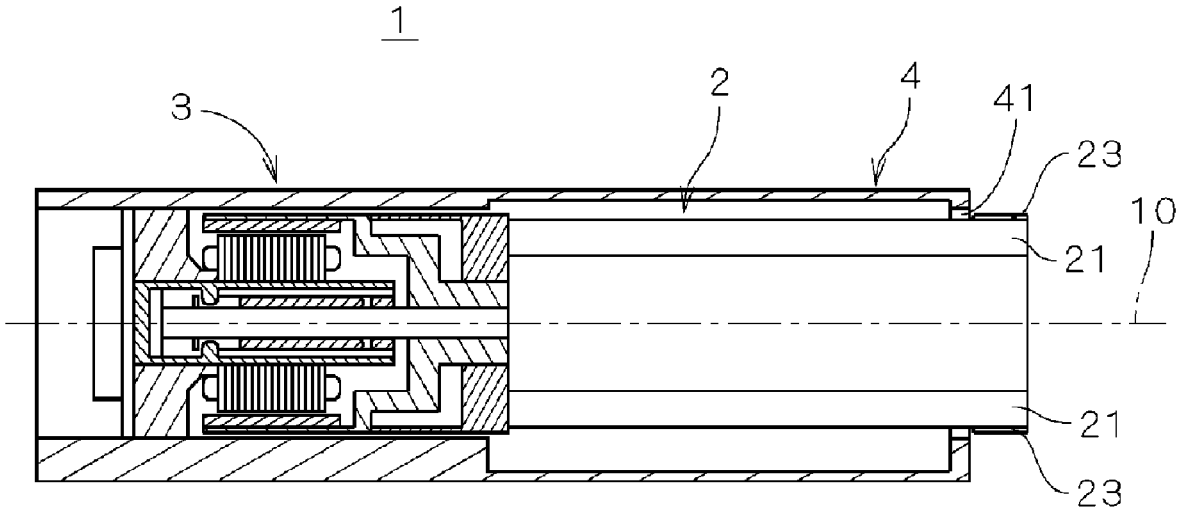
FIG. 8 is a longitudinal sectional view showing other example of the centrifugal fan.

FIG. 8 is a longitudinal sectional view showing other example of the centrifugal fan 1. The centrifugal fan 1 shown in FIG. 8 takes the same shape as that of the compact centrifugal fan 1 shown in FIG. 1 except that the entire circumference of the reinforcing ring 23 is exposed from the intake 41. In other words, the above-described condition is satisfied in the outer diameter of the impeller 2 and the shape of the blade 21. Further, the rotation number of the motor 3 is defined to be not less than 10,000 per minute. In order to prevent outflow of air, a space between the reinforcing ring 23 and the intake 41 is made sufficiently small. In the centrifugal fan 1 shown in FIG. 8, a space to house the reinforcing ring 23 within the housing 4 is not necessary, so that the outline of the centrifugal fan 1 on the section that is vertical to the center axis 10 can be downsized and the length in a direction of the center axis 10 can be also shortened. In addition, since the shape of the reinforcing ring 23 is not restricted by the housing 4, it is possible to easily increase the width and the thickness of the reinforcing ring 23, and thereby, modification of the blade 21 due to a high speed rotation can be prevented and the amount of blowing air and the static pressure can be more increased.

In the meantime, it is not necessary that the reinforcing ring 23 is entirely exposed and the entire circumference of a front end thereof may be only exposed. Further, a portion of the reinforcing ring 23 in a circumferential direction may be only exposed from the side of the housing 4. By exposing at least a portion of the reinforcing ring 23 from the housing 4, it is possible to make the length of the centrifugal fan 1 shorter and to downsize the outline of the centrifugal fan 1 at the section that is vertical to the center axis 10.

Figure 9:
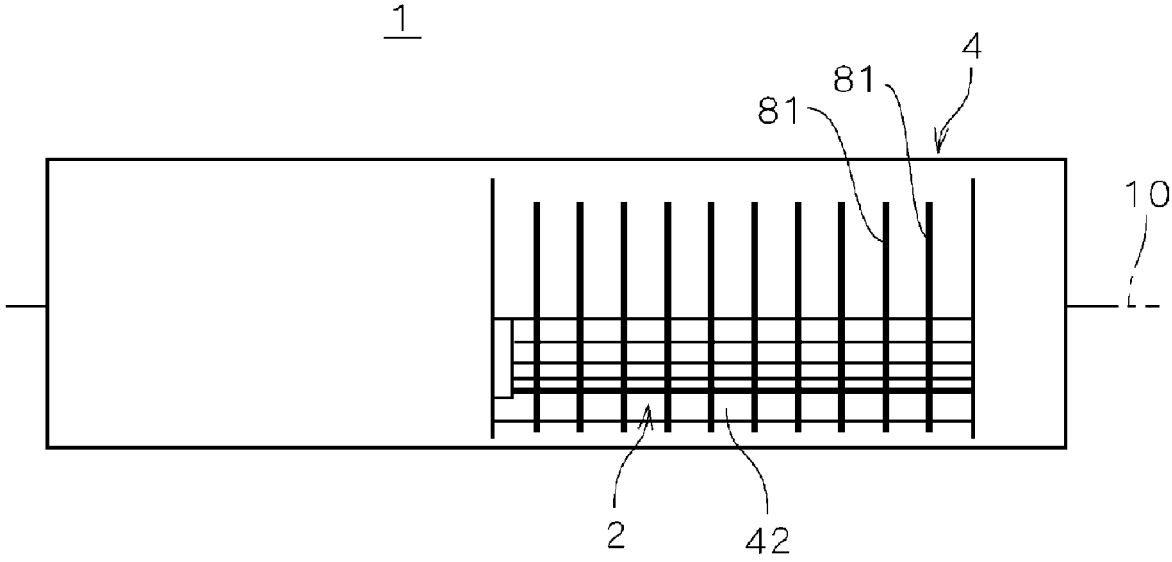
FIG. 9 is a front view showing further other example of the centrifugal fan.

FIG. 9 is a front view showing further other example of the centrifugal fan 1. In the centrifugal fan 1 shown in FIG. 9, a plurality of wires 81 for rectification is stretched across the air blowing port 42 in a direction orthogonal to the center axis 10. In the centrifugal fan 1 shown in FIG. 9, a whirlpool of air from the impeller 2 is divided into small whirlpools by the plural wires 81 and a frequency of the noise is made higher, so that uncomfortable noise can be relatively decreased. In the meantime, in place of the plural wires 81, for example, a plurality of thin plates may be arranged in the air blowing port 42 as a member for rectification.

Figure 10:
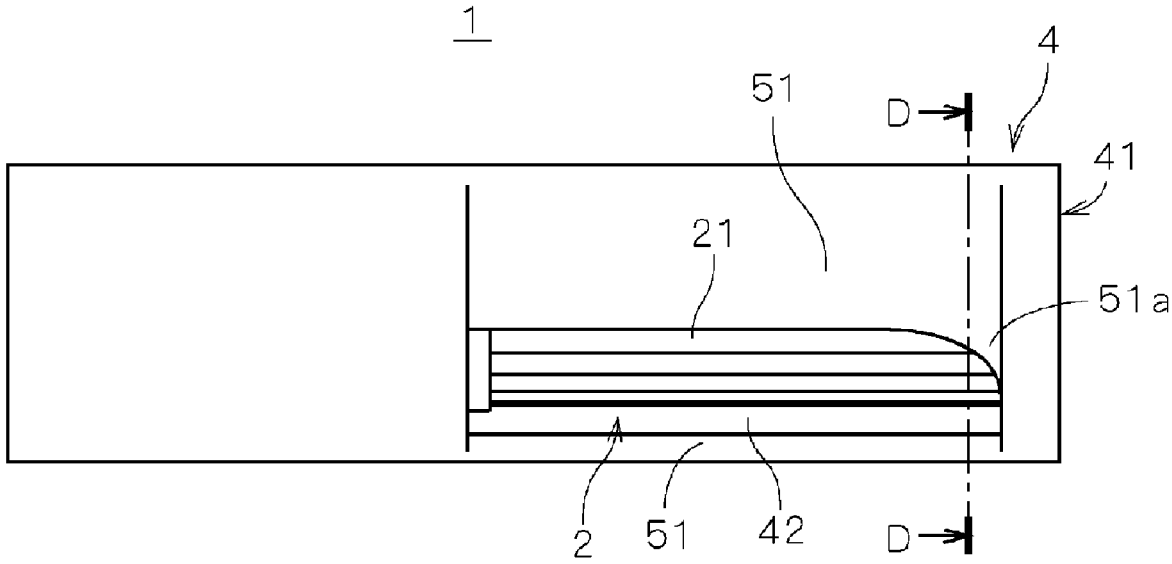
FIG. 10 is a front view showing still other example of the centrifugal fan.
Figure 11:
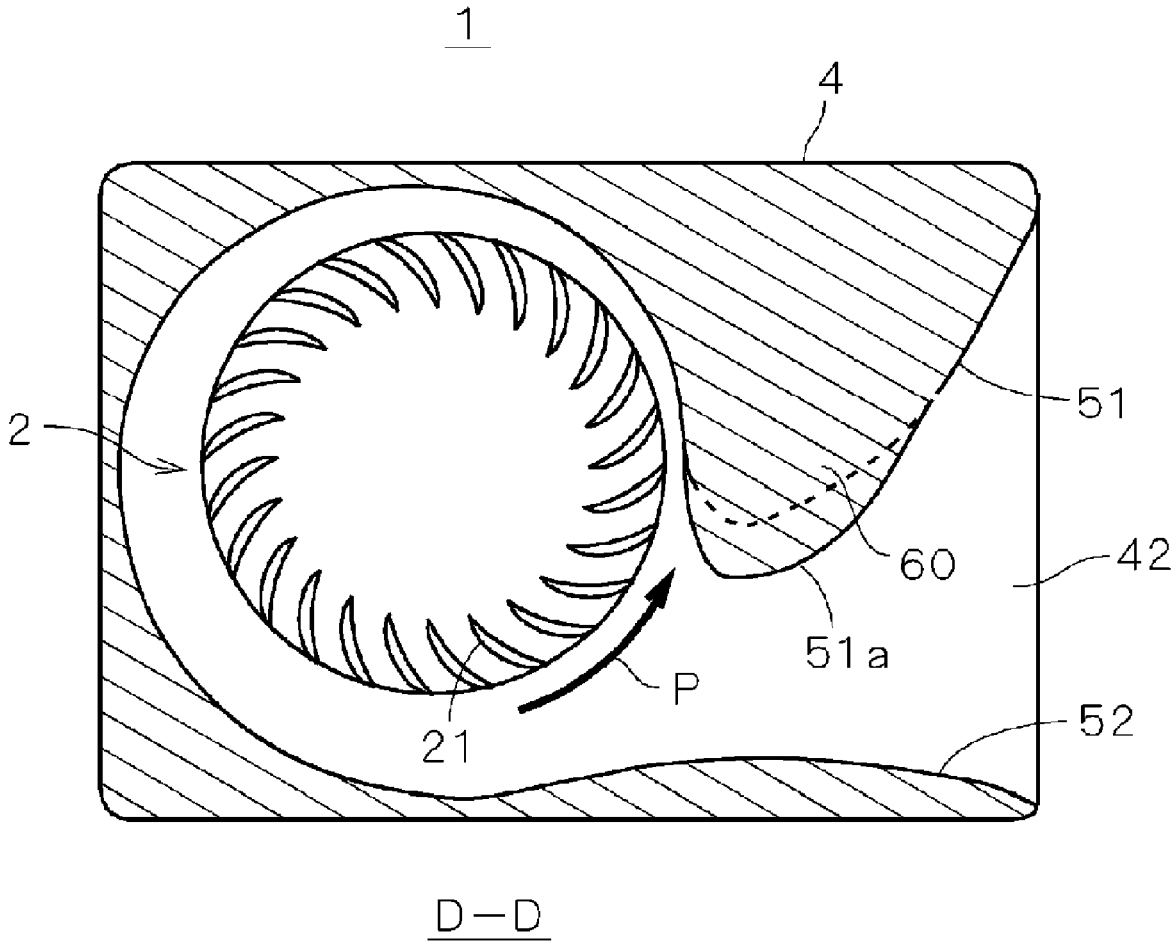
FIG. 11 is a cross sectional view showing the centrifugal fan.

FIG. 10 is a front view showing an example of a further modification of the centrifugal fan 1 shown in FIG. 1 and FIG. 2. The centrifugal fan 1 shown in FIG. 10 takes the same shape as that of the compact centrifugal fan 1 shown in FIG. 1 except for the shape of the air blowing port 42. In other words, the above-described condition is satisfied in the outer diameter of the impeller 2 and the shape of the blade 21, and further, the rotation number of the motor 3 is also defined to be not less than 10,000 per minute. FIG. 11 is a cross sectional view of the centrifugal fan 1 at a line D—D in FIG. 10 showing the centrifugal fan.

As shown in FIG. 10 and FIG. 11, at the end of the air blowing port 42 at the side of the intake 41, a lower end of the upper wall face 51 (namely, the nose portion 60 as a region in the vicinity of the edge in adjacent to the impeller 2 of the air blowing port 42) is expanded toward the side of the lower wall face 52 (hereinafter, this expanded region is referred to as "a nose expanded portion 51*a*"). In other words, at the end of the air blowing port 42 at the side of the intake 41, as shown in FIG. 11, the nose portion 60 is expanded in a direction opposed to a rotational direction P of the impeller 2 to form the nose expanded portion 51*a*. In the meantime, in FIG. 11, a normal shape of the nose portion 60 is illustrated by a broken line. In FIG. 10, by the nose expanded portion 51*a*, the edges of a corner at a right upper side of the air blowing port 42 are cut off (preferably, the edges are cut off in an elliptic arc (so-called R shape).

Normally, at the air blowing port of the centrifugal fan 1, the static pressure at a left side in FIG. 10 (the connection end side with the motor) is higher than that at a right side of the blade in FIG. 11 (the opening end side). Accordingly, in the case of the portable centrifugal fan having a long air blowing port 42 as the centrifugal fan 1, depending on a shape of the housing 4, adverse current of air such that the air blasted out at the end of the air blowing port 42 at the side of the intake 41 is immediately absorbed may occur. Therefore, in the centrifugal fan 1 shown in FIG. 10 and FIG. 11, the adverse current of air is prevented by providing the nose expanded portion 51 a, the static pressure can be increased at the end of the air blowing port 42 at the side of the intake 41.

The centrifugal fan 1 according to the embodiments of the present invention is described as above, however, the present invention is not limited to the above-described embodiments and various modifications are possible.

For example, the sectional shape of the blade 21 of the impeller 21 is not limited to the example of FIG. 3 and it may be flat. The blade 21 may be made not of a resin but of a metal. The housing 4 may be made of a resin or of a metal. The outline of the section that is vertical to the center axis 10 of the housing 4 is not necessarily a rectangular as shown in FIG. 3 and unnecessary angles may be cut off appropriately.

The sectional shapes of the air blowing port 42 and the inner face 50 are not limited to the example of FIG. 3 and they may be appropriately modified in consideration of an air blowing efficiency. Further, the reinforcing ring 23 is not limited to a cylindrical shape and it may be formed in a thick annular shape. A front end of the blade 21 may not be attached to the inside of the reinforcing ring 23 but may be connected to the end face of the reinforcing ring 23 at the side of the motor 3.

What is claimed is:

1. A centrifugal fan, comprising:

an impeller having an approximately cylindrical outline, the impeller designed for a minimum rotational operation speed of 10,000 rpm, by being configured with a plurality of blades arranged on a circumference of radius r, in which the length h in the impeller axial direction satisfies $2 \leqq h/r \leqq 20$ and r is not more than 25 mm, and a connection portion for fixing the ends of the blades at a first axial end thereof;

a motor that is connected to the impeller in the connection portion and rotates the impeller along one circumferential direction around a center axis the motor having an rpm rating of not less than 10,000;

a housing for housing the impeller;

an intake that is formed in the housing and opens opposite a second axial end of the impeller;

an air blowing port that is formed in the housing and opens opposite a longitudinal side of the impeller; and a gap enlarged portion, in which the distance between the outer circumference of the impeller and the inner face of the housing starts to increase at a point where the distance between the outer circumferential of the impeller and the surface of a nose portion is smallest therein, the nose portion being a region of the vicinity of an edge portion of the air blowing port, the edge portion being the closest side to the outer circumference of the impeller, such that the gap of the gap enlarged portion is expanding gradually along the other circumferential direction; wherein the normal operating speed of the centrifugal fan is at least 10,000 rpm.

2. The centrifugal fan according to claim 1, wherein the gap enlarged portion is provided in the range of 10 degrees to 115 degrees from the edge portion around the center axis of the impeller.

3. The centrifugal fan according to claim 1, wherein a width of an opening of the air blowing port is gradually increased toward the outside in a radial direction on a cross section that is vertical to the center axis of the housing.

4. The centrifugal fan according to claim 3, wherein at least one side of the air blowing port has smooth convex shape toward other side on a cross section that is vertical to the center axis of the housing.

5. The centrifugal fan according to claim 1, wherein an edge of the air blowing port at a first axial end thereof is disposed alongside the first axial end of the blades.

6. The centrifugal fan according to claim 1, further comprising, a reinforcing ring for fixing the blades at one end in the axial direction, the reinforcing ring having a shape that a region of the nose portion opposed to the reinforcing ring is deleted.

7. The centrifugal fan according to claim 1, further comprising a reinforcing ring for fixing the blades at one end in the axial direction; wherein, at least a portion of the reinforcing ring is exposed from the housing to the outside.

8. The centrifugal fan according to claim 1, wherein the nose portion is expanded toward the other circumferential direction at the side portion of the air blowing port, the side portion being the nearest to the intake.

9. A centrifugal fan, comprising:

an impeller having an approximately cylindrical outline defining a radius r, the radius r being not more than 25 mm, the impeller designed for a minimum rotational operating speed of 10,000 rpm, and including a plurality of blades extended in an axial direction;

a connection portion for fixing the ends of the blades at a first axial end thereof;

a motor that is connected to the impeller in the connection portion and rotates the impeller along one circumferential direction around a center axis, the motor having an rpm rating of not less than 10,000;

a housing for housing the impeller;

an intake that is formed in the housing and opens opposed to a second end in the axial direction of the impeller;

an air blowing port that is formed in the housing and opens opposed to a side of the impeller; wherein, a gap between the outer circumference of the impeller and the surface of a nose portion, the nose portion being a region of the vicinity of an edge portion of the air blowing port, the edge portion being the closest side to the outer circumference of the impeller, is expanding along the other circumferential direction at the side portion of the air blowing port, the side portion being the nearest to the intake; wherein the normal operating speed of the centrifugal fan is at least 10,000 rpm.

10. The centrifugal fan according to claim 9, wherein, letting the axial length of the blades be h, the length h satisfies $h/20 \leqq r \leqq h/2$.

* * * * *